US008696320B2

(12) United States Patent
Harris, Jr. et al.

(10) Patent No.: US 8,696,320 B2
(45) Date of Patent: Apr. 15, 2014

(54) GAS TURBINE HAVING SEAL ASSEMBLY WITH COVERPLATE AND SEAL

(75) Inventors: John Wesley Harris, Jr., Taylors, SC (US); Matthew Robert Piersall, Greenville, SC (US); Brian Denver Potter, Greer, SC (US)

(73) Assignee: General Electric Company, Schenectady, NY (US)

( * ) Notice: Subject to any disclaimer, the term of this patent is extended or adjusted under 35 U.S.C. 154(b) by 727 days.

(21) Appl. No.: 12/402,800

(22) Filed: Mar. 12, 2009

(65) Prior Publication Data

US 2010/0232938 A1 Sep. 16, 2010

(51) Int. Cl.
*F03B 3/12* (2006.01)

(52) U.S. Cl.
USPC ..... 416/248; 416/244 R

(58) Field of Classification Search
USPC ..... 415/175; 416/95, 174, 244 R, 248
See application file for complete search history.

(56) References Cited

U.S. PATENT DOCUMENTS

| | | | | |
|---|---|---|---|---|
| 3,043,562 | A | | 7/1962 | Van Nest et al. |
| 3,137,478 | A | | 6/1964 | Farrell |
| 3,318,573 | A | | 5/1967 | Matsuki et al. |
| 3,501,249 | A | | 3/1970 | Scalzo et al. |
| 3,751,183 | A | | 8/1973 | Nichols et al. |
| 3,768,924 | A | | 10/1973 | Corsmeier et al. |
| 3,814,539 | A | | 6/1974 | Klompas |
| 3,829,233 | A | | 8/1974 | Scalzo et al. |
| 3,853,425 | A | | 12/1974 | Scalzo et al. |
| 4,019,833 | A | | 4/1977 | Gale |
| 4,021,138 | A | | 5/1977 | Scalzo et al. |
| 4,088,421 | A | | 5/1978 | Hoeft |
| 4,111,603 | A | | 9/1978 | Stahl |
| 4,218,189 | A | | 8/1980 | Pask |
| 4,265,594 | A | | 5/1981 | Eggmann |
| 4,326,835 | A | * | 4/1982 | Wertz ..... 416/193 A |
| 4,355,957 | A | | 10/1982 | Sifford et al. |
| 4,480,958 | A | | 11/1984 | Schlechtweg |
| 4,500,098 | A | * | 2/1985 | Wilcox et al. ..... 277/641 |
| 4,507,052 | A | | 3/1985 | Thompson |
| 4,523,890 | A | | 6/1985 | Thompson |
| 4,645,424 | A | | 2/1987 | Peters |
| 4,659,285 | A | | 4/1987 | Kalogeros et al. |

(Continued)

FOREIGN PATENT DOCUMENTS

| | | |
|---|---|---|
| CN | 1719002 A | 1/2006 |
| CN | 101225754 | 7/2008 |

(Continued)

OTHER PUBLICATIONS

Niesz, U.S. Appl. No. 12/402,808, Office Action Correspondence, 233057-1, Aug. 19, 2011, 8 pages.

(Continued)

*Primary Examiner* — Zandra Smith
*Assistant Examiner* — Jamie C Niesz
(74) *Attorney, Agent, or Firm* — Ernest G. Cusick; Hoffman Warnick LLC

(57) ABSTRACT

A gas turbine and a seal assembly for a machine having a rotating shaft, a wheel coupled to the rotating shaft, the wheel including a bucket coupled to the wheel comprising a coverplate that is fastened to the wheel and the bucket and a seal positioned between the coverplate and the wheel and the bucket.

20 Claims, 5 Drawing Sheets

(56) References Cited

U.S. PATENT DOCUMENTS

| | | | | |
|---|---|---|---|---|
| 4,659,289 | A | 4/1987 | Kalogeros | |
| 4,743,164 | A | 5/1988 | Kalogeros | |
| 4,781,534 | A | 11/1988 | Ferleger | |
| 5,222,742 | A | 6/1993 | Roberts | |
| 5,236,302 | A | 8/1993 | Weisgerber et al. | |
| 5,257,909 | A | 11/1993 | Glynn et al. | |
| 5,275,534 | A | 1/1994 | Cameron et al. | |
| 5,277,548 | A | 1/1994 | Klein et al. | |
| 5,338,154 | A | 8/1994 | Meade et al. | |
| 5,388,962 | A | 2/1995 | Wygle et al. | |
| 5,429,478 | A | 7/1995 | Krizan et al. | |
| 5,503,528 | A | 4/1996 | Glezer et al. | |
| 5,659,289 | A | 8/1997 | Zonkoski et al. | |
| 5,803,710 | A | 9/1998 | Dietrich et al. | |
| 5,924,843 | A | 7/1999 | Staub et al. | |
| 5,954,477 | A | 9/1999 | Balsdon | |
| 5,967,745 | A | 10/1999 | Tomita et al. | |
| 5,993,160 | A | 11/1999 | Bouchard et al. | |
| 6,042,951 | A | 3/2000 | Kojima et al. | |
| 6,086,329 | A | 7/2000 | Tomita et al. | |
| 6,106,234 | A * | 8/2000 | Gabbitas | 416/221 |
| 6,120,249 | A | 9/2000 | Hultgren et al. | |
| 6,189,891 | B1 | 2/2001 | Tomita et al. | |
| 6,190,131 | B1 | 2/2001 | Deallenbach | |
| 6,220,814 | B1 | 4/2001 | Brushwood et al. | |
| 6,273,683 | B1 | 8/2001 | Zagar et al. | |
| 6,315,298 | B1 | 11/2001 | Kildea et al. | |
| 6,506,016 | B1 * | 1/2003 | Wang | 415/173.7 |
| 6,561,764 | B1 | 5/2003 | Tiemann | |
| 6,776,573 | B2 | 8/2004 | Arilla et al. | |
| 6,945,749 | B2 | 9/2005 | De Cardenas | |
| 7,121,800 | B2 | 10/2006 | Beattie | |
| 7,189,055 | B2 | 3/2007 | Marini et al. | |
| 7,241,109 | B2 | 7/2007 | Ferra | |
| 7,264,447 | B2 | 9/2007 | Ono et al. | |
| 7,264,448 | B2 | 9/2007 | Garner | |
| 8,226,366 | B2 | 7/2012 | Brucher et al. | |
| 2004/0062643 | A1 | 4/2004 | Brauer et al. | |
| 2006/0021218 | A1 * | 2/2006 | McMillan | 29/888.3 |
| 2007/0258816 | A1 * | 11/2007 | Bouchard et al. | 416/193 A |
| 2010/0196164 | A1 * | 8/2010 | Liotta et al. | 416/220 R |

FOREIGN PATENT DOCUMENTS

| | | | | |
|---|---|---|---|---|
| GB | 2148404 | | 5/1985 | |
| GB | 2262139 | | 9/1993 | |
| JP | 59-010704 | | 8/1982 | |
| JP | H1162502 | | 3/1999 | |
| JP | 2008-169838 | | 7/2008 | |
| RU | 2076227 | * | 3/1997 | F02F 5/00 |
| WO | 9950534 | | 10/1999 | |

OTHER PUBLICATIONS

Niesz, Jamie C., Final Office Action, U.S. Appl. No. 12/402,808, Jan. 6, 2012, 11 pages.

Niesz, U.S. Appl. No. 12/402,808, Office Action Communication, 233057-1, Mar. 28, 2013, 18 pages.

Niesz, U.S. Appl. No. 12/402,808, Office Action Communication, 233057-1, Aug. 29, 2013, 15 pages.

EP Application No. 10156207.2-1610, Office Action Communication dated Aug. 8, 2013, 8 pages.

CN Application No. 201010146904.7, Office Action Correspondence dated Jul. 22, 2013, 11 pages.

Japanese Application No. 2010-052475, Office Action dated Nov. 26, 2013, 6 pages.

* cited by examiner

GAS TURBINE HAVING SEAL ASSEMBLY WITH COVERPLATE AND SEAL

CROSS-REFERENCE TO RELATED APPLICATION

The current application is related to U.S. patent application Ser. No. 12/402,808, titled "MACHINE SEAL ASSEMBLY," filed on Mar. 12, 2009.

BACKGROUND OF THE INVENTION

The subject matter disclosed herein relates generally to gas turbines and a seal assembly for machines and more specifically to a coverplate and seal assembly to improve the operation, performance and efficiency of a gas turbine and machine. Gas turbine and machine performance are degraded by the loss of pressurized cooling air and ingestion of hot gas flow.

BRIEF DESCRIPTION OF THE INVENTION

A gas turbine and a seal assembly for a machine having a rotating shaft, a wheel coupled to the rotating shaft, the wheel including a bucket coupled to the wheel comprising a coverplate that is fastened to the wheel and the bucket and a seal positioned between the coverplate and the wheel and the bucket.

A first aspect of the invention provides a gas turbine comprising: a rotating shaft, a wheel coupled to the rotating shaft, the wheel including a bucket coupled to the wheel, a coverplate fastened to the wheel and the bucket, and a seal positioned between the coverplate and the wheel and the bucket.

A second aspect of the invention provides a seal assembly for a machine having a rotating shaft, the seal assembly comprising: a wheel coupled to the rotating shaft, the wheel including a bucket coupled to the wheel, a coverplate fastened to the wheel and the bucket of the machine, and a seal positioned between the coverplate and the wheel and the bucket.

BRIEF DESCRIPTION OF THE DRAWINGS

These and other features of the disclosure will be more readily understood from the following detailed description of the various aspects of the invention taken in conjunction with the accompanying drawings that depict various aspects of the invention, in which.

It is noted that the drawings are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide improved operation, performance and efficiency of a machine. As used throughout this application, reference to machine is to include: a gas turbine, a steam turbine or a compressor. In one embodiment, the invention discussed herein includes a coverplate that is fastened to a wheel and bucket of a machine and a seal positioned between the coverplate and the wheel and the bucket. One feature of the coverplate and seal on the machine is that it reduces the loss of pressurized air from the system. Additionally, the coverplate and seal may prevent the inflow of hot gas into the wheelspace and aid in the secondary air flow of the machine. Moreover, the coverplate and seal discussed herein may facilitate maintenance on the machine. Furthermore, the coverplate and seal may facilitate assembly and disassembly of the machine as the coverplate and seal can be installed and removed while the rotating shaft is on the half shell. The coverplate and seal may also improve the machine's performance by acting as a heat shield and reduce vibration through the addition of damping. The coverplate and seal can be installed on a forward side or an aft side of the wheel. Alternatively, the coverplate and seal can be installed on the forward side and the aft side of the wheel.

Figure 1:
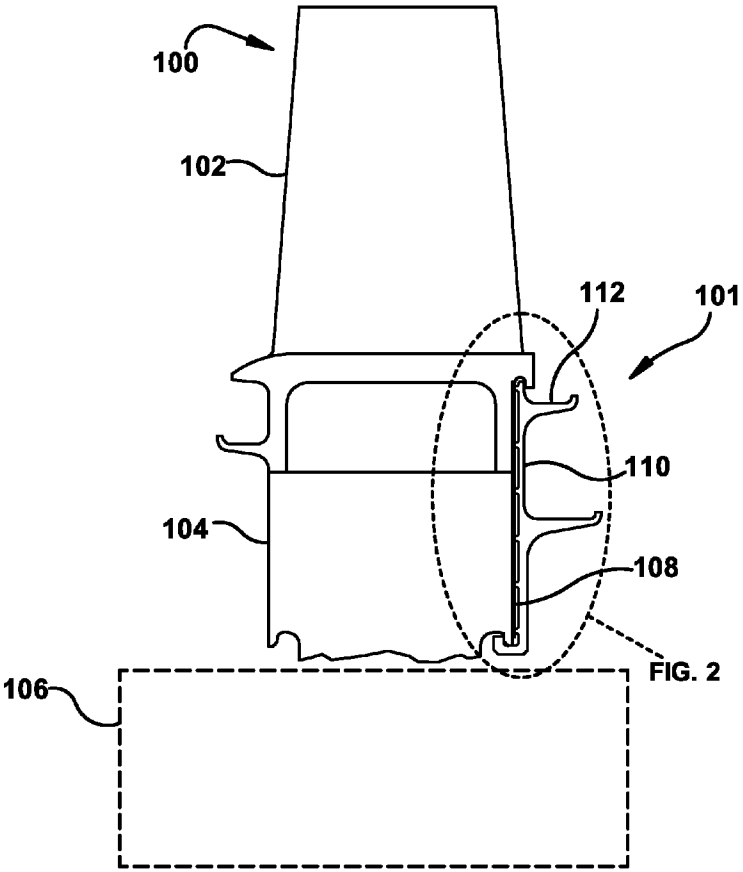
FIG. 1 shows a cross-sectional view of a bucket and wheel from a machine.

Turning to the drawings, FIG. 1 shows a cross-sectional view of a relevant portion of a machine 100 including seal assembly 101. Machine 100 includes a bucket 102, a wheel 104 and a rotating shaft 106. As understood, at least one wheel 104 is coupled to rotating shaft 106 of machine 100. Each wheel 104 may include a plurality of buckets 102 upon which gas acts to turn rotating shaft 106.

Figure 2:
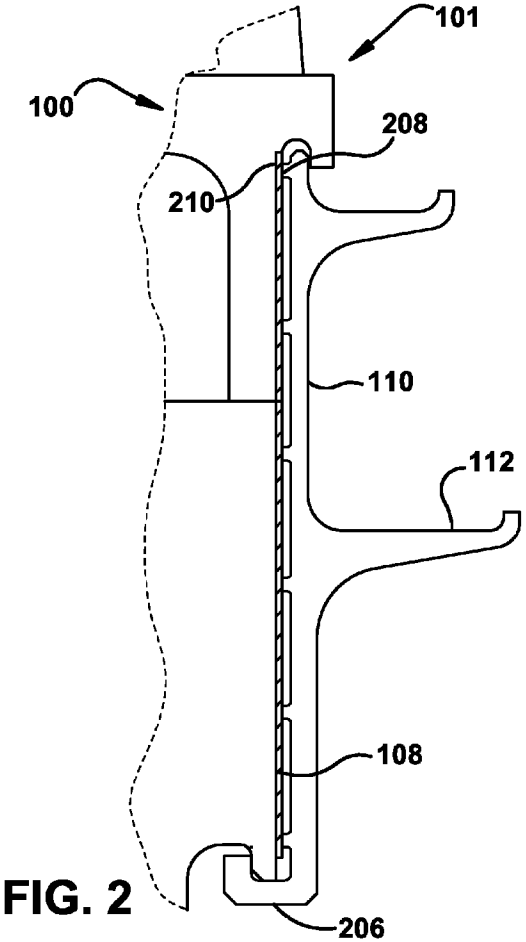
FIG. 2 shows a cross-sectional view of a bucket and wheel from a machine with an enlarged view from an area of FIG. 1 illustrating a coverplate and seal.

FIG. 2 shows an enlarged view of a relevant portion of FIG. 1. Seal assembly 101 includes a seal 108, a coverplate 110 and an angel wing 112. In one embodiment, coverplate 110 fastens to wheel 104 of machine 100 using a hook 206. Alternative embodiments for fastening coverplate 110 to wheel 104 may include, for example: a bolt, a pin, a stack or a bayonet retaining ring. In another embodiment, coverplate 110 can include an outer edge 208 that engages a slot 210 in bucket 102 of machine 100.

Figure 3:
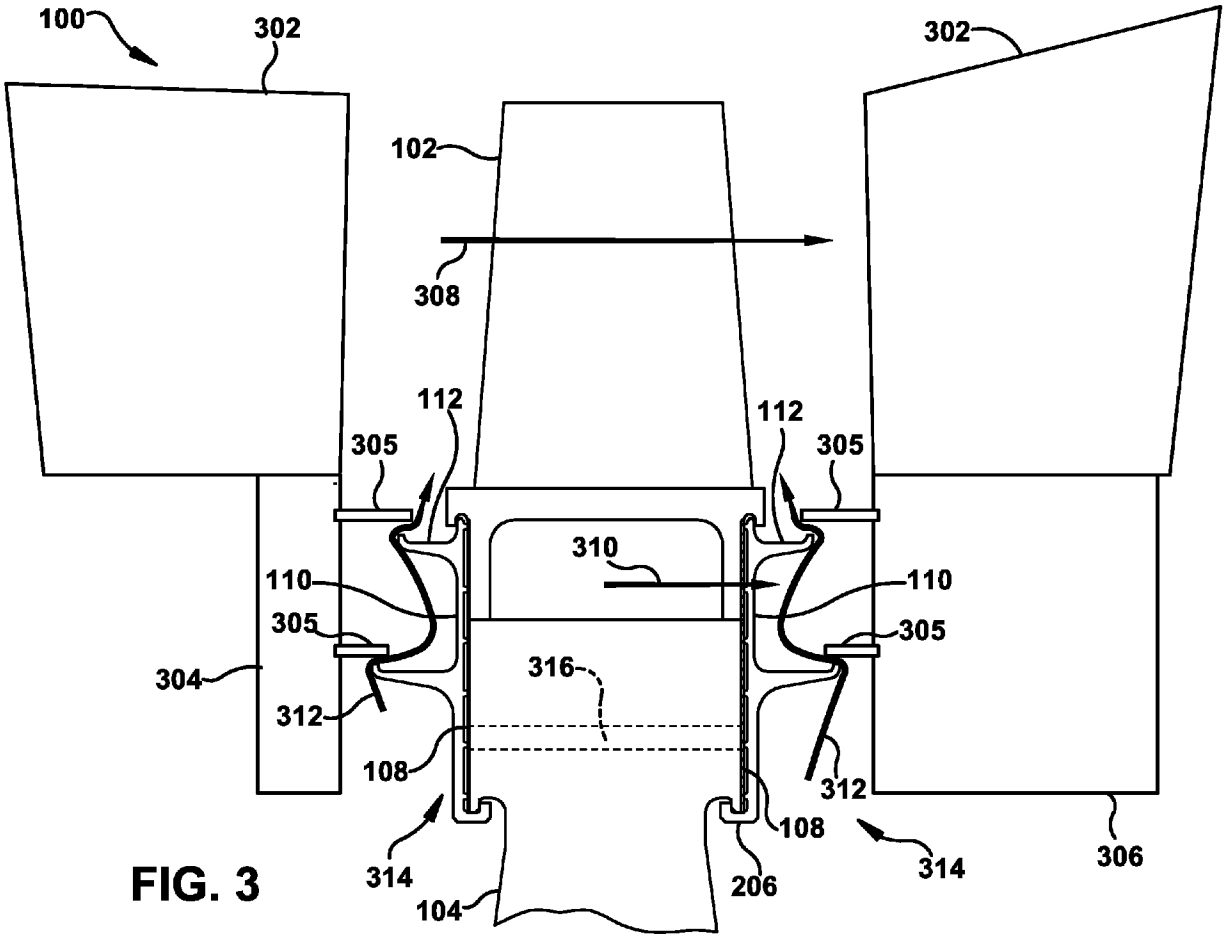
FIG. 3 shows a cross-sectional view of a machine showing gas and air flow movement.

FIG. 3 shows a cross-sectional view of machine 100 showing gas and air flow movement. FIG. 3 shows a nozzle 302 of machine 100. As illustrated, nozzle 302 is located on both sides of bucket 102. It is understood, however, that nozzle 302 would be present only on a forward side of bucket 102 where the bucket is a last stage bucket. A hot gas flow 308 moves across bucket 102. Immediately below nozzle 302 on the forward (left) or upstream side of machine 100 is a nozzle support ring 304. Immediately below nozzle 302 on the aft (right) or downstream side of machine 100 is a diaphragm 306. Nozzle 302 includes on both the forward and aft sides, a part 305 that extends from nozzle 302 towards wheel 104. A wheelspace 314 exists on the forward and aft side of bucket 102. On the forward side, wheelspace 314 is between nozzle supporting ring 304 and wheel 104. On the aft side, wheelspace 314 is between diaphragm 306 and wheel 104.

Wheelspace purge air 312 moves through wheelspace 314. Additionally, bucket supply cooling air (not shown) moves from wheel 104 towards bucket 102. An illustration of the movement of wheelspace purge air 312 is shown as it moves through wheelspace 314 and across wheel 104. Coverplate 110 aids in reducing the amount of wheelspace purge air 312 that is able to move between wheel 104 and nozzle support ring 304 on the forward side and wheel 104 and diaphragm 306 on the aft side. Additionally, coverplate 110 aids in the bucket supply cooling air reaching bucket 102 and not entering wheelspace 314. As described above, in one embodiment coverplate 110 and seal 108 can be installed on a forward side or an aft side of wheel 104 (FIG. 1). In another embodiment, coverplate 110 and seal 108 can be installed on the forward side and the aft side of wheel 104. Additionally, there may be one or more angel wings 112 on coverplate 110. Angel wing 112 may aid in preventing the hot flowpath gas from entering wheelspace 314.

When there is no coverplate 110 and seal 108 present, wheelspace purge air 312 is able to enter perforation 316 in wheel 104. When coverplate 110 and seal 108 are present, it may reduce or eliminate the amount of wheelspace purge air 312 entering or moving through wheel 104 into wheelspace 314. If no coverplate 110 and seal 108 are installed, wheelspace purge air 310 would be able to move between wheel 104 and wheelspace 314. Coverplate 110 and seal 108 aid in preventing the loss of wheelspace purge air 312. Moreover, when there is no coverplate 110 and seal 108 present, bucket supply cooling air may enter wheelspace 314.

In one embodiment, coverplate 110 may be segmented. In another embodiment, seal 108 may be segmented. In a further embodiment, both coverplate 110 and seal 108 may be segmented. In an alternative embodiment, shown in FIG. 8, where there is a segmented coverplate 806 and a segmented seal 700 or either segmented coverplate 806 or segmented seal 700, seal 108 is positioned to overlap an interface 804 on segment coverplate 806 to eliminate a gap between adjacent circumferentially positioned coverplate segments 802.

Coverplate 110 and seal 108 can also be used to aid in the secondary flow design of machine 100. Specifically, coverplate 110 and seal 108 can be installed and positioned to aid in the movement of air and gas flow to directed locations. Moreover, coverplate 110 and seal 108 can be installed and positioned to prevent leakages of pressurized air (e.g., wheelspace purge air and bucket supply cooling air) and ingestion of hot gas. Additionally, coverplate 110 and seal 108 can be used as a heat shield for wheel 104 by reducing the amount of hot gas flow 308 that contacts or comes in proximity to wheel 104 or by providing an additional barrier between bucket 102 and wheel 104. In a further embodiment, coverplate 110 and seal 108 can be used to dampen vibration on wheel 104 and bucket 102 and for machine 100 as a whole. For example, coverplate 110 and seal 108 can provide an additional mechanical connection between wheel 104 and bucket 102. The additional connection between bucket 102 and wheel 104 may provide increased rigidity and reduce the vibration while machine 100 is in operation.

Figure 4:
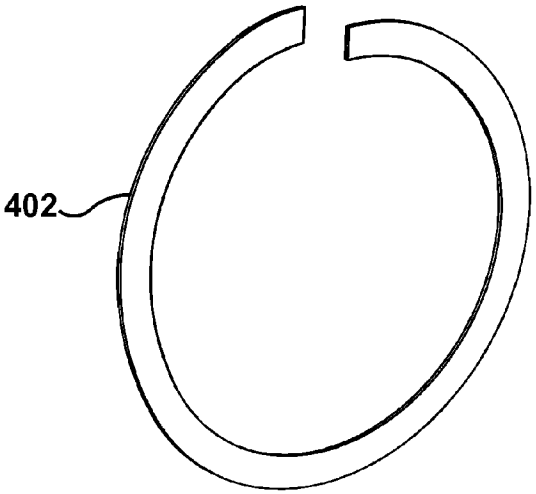
FIG. 4 shows a 360-degree single coil seal with a single split.

Turning to FIG. 4, a 360-degree single coil seal with a single split ("single coil seal") 402 is shown. The single coil seal 402 allows for installation and maintenance, including assembly and disassembly, on machine 100 both at the factory and when machine 100 is at a customer's site. In one embodiment, the single coil seal 402 allows for the seal to be spread apart allowing for maintenance and repair of machine 100. In a further embodiment, by single coil seal 402 having a break in its circumference, it provides the flexibility so that it may be maneuvered on and off of machine 100. In another embodiment, single coil seal 402 with its single split retains the rigidity and durability where it can perform as described in detail above, and be installed and removed from machine 100.

Figure 5:
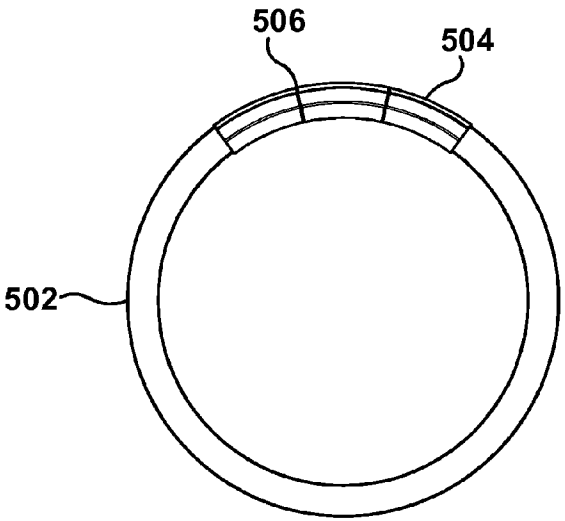
FIG. 5 shows a 360-degree single coil seal with a single split wherein the ends of the split are mechanically coupled and there is a segmented coverplate over the mechanically coupled ends of the single coil seal.

Turning to FIG. 5, and with continuing reference to FIG. 4, the ends of single coil seal 502 can be mechanically coupled by, for example, a tongue and groove, a lap joint, a dovetail, a butt joint, a weld or a braze. Additionally, a coverplate 504 can be placed over the joint in the single coil seal 502 when it is mechanically coupled. In one embodiment, a mechanically coupled single coil seal with a coverplate 504 will have the single coil seal 402 positioned on the coverplate 504 to eliminate a gap 506 between adjacent circumferentially positioned coverplate segments 504.

Figure 6:
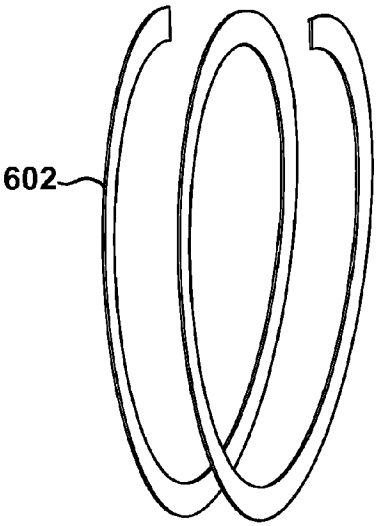
FIG. 6 shows a 720-degree multi-coil seal.

FIG. 6 illustrates a 720-degree multi coil seal ("multi coil seal") 602. In one embodiment, the ends of the multi coil seal are not mechanically coupled to one another. This allows for flexibility in the seal during installation and maintenance of machine 100 in addition to installation and removal of multi coil seal 602 on machine 100. Other embodiments may include a multi coil seal having more than 720 degrees, if desired.

Figure 7:
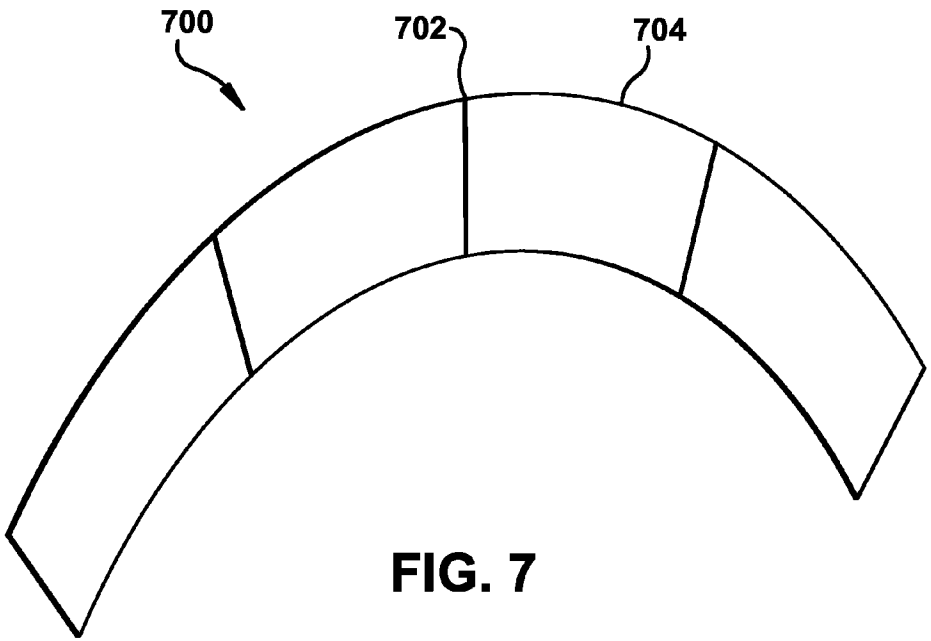
FIG. 7 shows a portion of a segmented seal.
Figure 8:
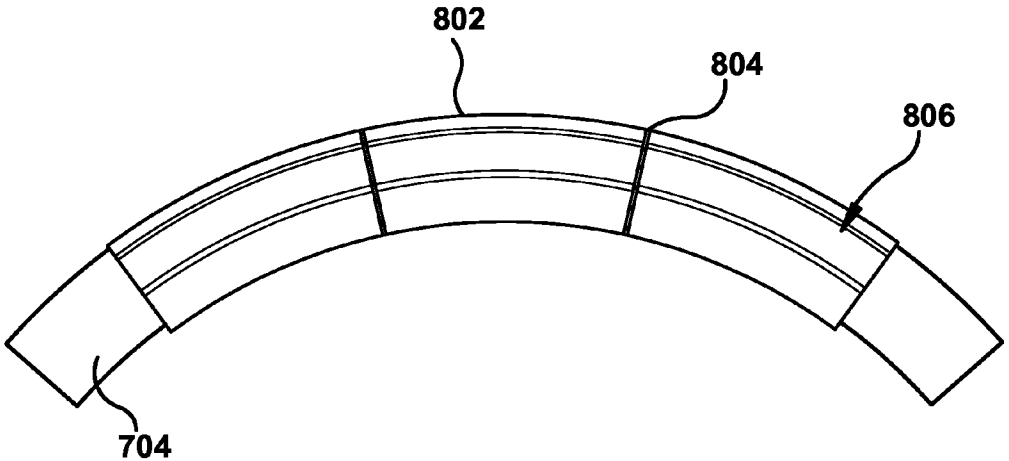
FIG. 8 shows a portion of a segmented seal with a segmented coverplate over the segmented seal.

Turning to FIG. 7, a portion of a segmented seal 700 is illustrated. Segmented seal 700 includes a joint 702 where segments 704 connect. In one embodiment, a coverplate 110 can be installed over a segmented seal 700. FIG. 8 shows a segmented seal 700 with a segmented coverplate 806 over segmented seal 700. Examining FIG. 8, with continuing reference to FIG. 7, in one embodiment a coverplate joint 804 can be staggered from joint 702 of segmented seal 700 where the segmented seal 700 is positioned on the coverplate segment 804 to eliminate a gap between adjacent circumferentially positioned coverplate segments.

Figure 9:
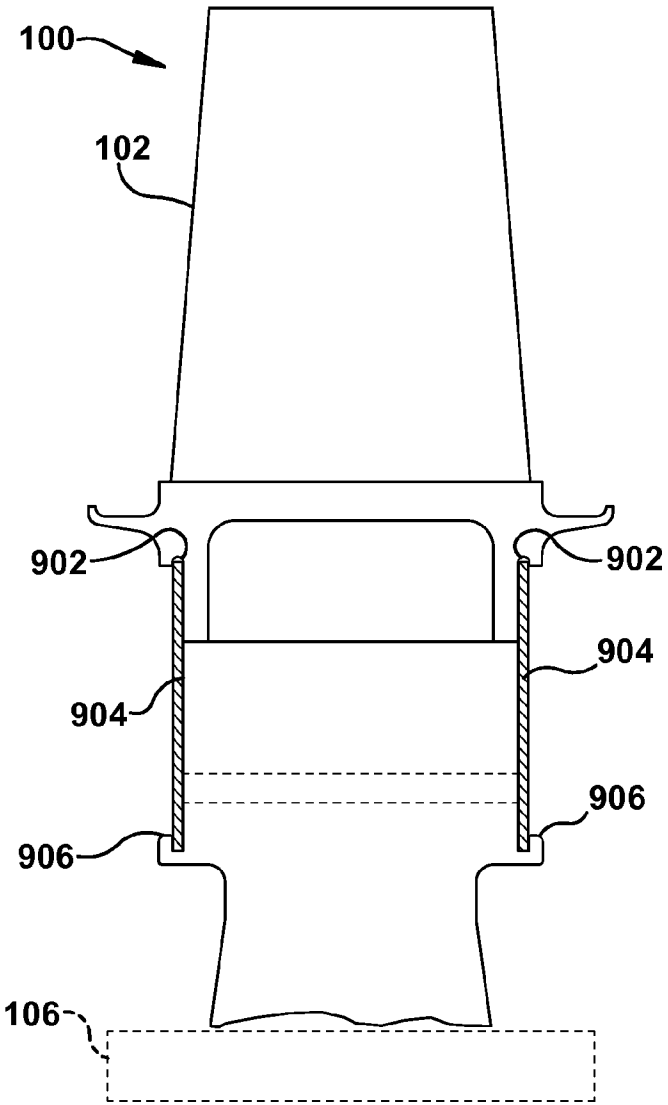
FIG. 9 shows a cross sectional view of a bucket and wheel from a machine.

Turning to FIG. 9, this figure illustrates an alternative embodiment wherein a seal 904 extends along a side of bucket 102 and wheel 104 covering an interface therebetween. Seal 904 may attach to bucket 102 by a hook 902 on bucket 102 and seal 904 may attach to wheel 104 by a hook 906 on wheel 104. Seal 904 may be on the forward or aft side of wheel 104. In an additional embodiment, seal 904 may be may be on the forward and aft side of wheel 104. Seal 904 may take the form of any of the above-described seals.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A gas turbine comprising:

a rotating shaft;

a wheel coupled to the rotating shaft;

a bucket coupled to the wheel;

a coverplate fastened to the wheel and the bucket; and a sheet seal positioned between the coverplate and an interface between the wheel and the bucket, wherein the sheet seal extends along a side of the bucket and the wheel to cover and seal the entire interface between the wheel and the bucket, and wherein the coverplate is positioned over the entire sheet seal.

2. The gas turbine of claim 1, wherein the coverplate includes an angel wing.

3. The gas turbine of claim 1, wherein the coverplate includes a hook for fastening the coverplate to the wheel of the gas turbine.

4. The gas turbine of claim 1, wherein the coverplate includes an outer edge that engages a slot in the bucket of the gas turbine.

5. The gas turbine of claim 1, wherein the sheet seal includes a 360-degree seal with a single split.

6. The gas turbine of claim 1, wherein the sheet seal includes a 720-degree multi-coil seal.

7. The gas turbine of claim 1, wherein the sheet seal includes a segmented seal.

8. The gas turbine of claim 1, wherein the coverplate includes at least one segment and the sheet seal is positioned on the at least one coverplate segment to eliminate a gap between adjacent circumferentially positioned coverplate segments.

9. The gas turbine of claim 1, wherein the coverplate includes a hook for fastening the coverplate to the wheel and the bucket includes a hook for fastening the sheet seal to the bucket.

10. The gas turbine of claim 1, wherein the coverplate and sheet seal cover the interface between the wheel and the bucket.

11. A seal assembly for a machine having a rotating shaft, the seal assembly comprising:

a wheel coupled to the rotating shaft;

a bucket coupled to the wheel;

a coverplate fastened to the wheel and the bucket of the machine; and a sheet seal positioned between the coverplate and an interface between the wheel and the bucket, wherein the sheet seal extends along a side of the bucket and the wheel to cover and seal the entire interface between the wheel and the bucket, and wherein the coverplate is positioned over the entire sheet seal.

12. The seal assembly of claim 11, wherein the coverplate includes an angel wing.

13. The seal assembly of claim 11, wherein the coverplate includes a hook for fastening the coverplate to the wheel of the machine.

14. The seal assembly of claim 11, wherein the coverplate includes an outer edge that engages a slot in the bucket of the machine.

15. The seal assembly of claim 11, wherein the sheet seal includes a 360-degree seal with a single split.

16. The seal assembly of claim 11, wherein the sheet seal includes a 720-degree multi-coil seal.

17. The seal assembly of claim 11, wherein the sheet seal includes a segmented seal.

18. The seal assembly of claim 11, wherein the coverplate includes at least one segment and the sheet seal is positioned on the at least one coverplate segment to eliminate a gap between adjacent circumferentially positioned coverplate segments.

19. The seal assembly of claim 11, wherein the coverplate includes a hook for fastening the coverplate to the wheel and the bucket includes a hook for fastening the sheet seal to the bucket.

20. The seal assembly of claim 11, wherein the coverplate and sheet seal cover the interface.

* * * * *